United States Patent [19]

Charles

[11] 4,364,712

[45] Dec. 21, 1982

[54] CROSS FLOW COOLING FAN

[75] Inventor: Herbert N. Charles, Chatham, Canada

[73] Assignee: Canadian Fram, Chatham, Canada

[21] Appl. No.: 168,233

[22] Filed: Jul. 10, 1980

[51] Int. Cl.[3] ..... F04D 29/26

[52] U.S. Cl. ..... 416/183; 416/189; 416/237

[58] Field of Search ..... 416/183, 189 R, 237, 416/192

[56] References Cited

U.S. PATENT DOCUMENTS

| | | | |
|---|---|---|---|
| 911,540 | 2/1909 | Guilford | 416/189 R X |
| 984,812 | 2/1911 | Hearst | 416/189 R |
| 1,072,189 | 9/1913 | Sparks | 416/189 R |
| 1,383,883 | 7/1921 | Truitt | 416/243 X |
| 1,467,227 | 9/1923 | Capell | 416/189 R |
| 1,620,875 | 3/1927 | Currie | 416/237 X |
| 1,668,462 | 5/1928 | Oswald | 416/237 R |
| 1,745,441 | 2/1930 | Norberg | 416/183 |
| 2,011,298 | 8/1935 | Osbun et al. | 416/237 |
| 2,378,049 | 6/1945 | Upson | 416/243 X |
| 2,540,136 | 2/1951 | Oliphant | 416/237 X |
| 2,779,424 | 1/1957 | Lyon | 416/192 |
| 3,444,817 | 5/1969 | Caldwell | 416/183 X |

FOREIGN PATENT DOCUMENTS

| | | | |
|---|---|---|---|
| 1399313 | 4/1965 | France | 416/242 |

*Primary Examiner*—Everette A. Powell, Jr.
*Attorney, Agent, or Firm*—Ken C. Decker; William N. Antonis

[57] ABSTRACT

A cross flow fan (10) imparts both radial and axial flow components to airflow passing through the fan, resulting in a conical exit airflow. The fan includes a hub (12) and circumferentially spaced, radially extending fan blades (14, 16, 18, 20, 22, and 24). Backing plate portion (34, 36, 38, 40, 42, and 44) is associated with each of the blades 14–24. The backing plate portions lie on a conical plane which rakes backwardly from the hub in a direction downstream from the fan. The fan blades are disposed in a plane oblique to their corresponding backing plate portions, so that they intersect the latter along a joining edge (50). Each of the fan blades includes portions having greater (56) and lesser (58) radii of curvature. The portions (58) of lesser radii of curvature cooperate with the corresponding backing plate portions (36) to provide a radial component to the flow through the fan whereas the leading edge portions (56) provide the axial flow component.

8 Claims, 6 Drawing Figures

CROSS FLOW COOLING FAN

This invention relates to a fan for the cooling system of an automotive vehicle.

All motor cooling fans have been used in the cooling system of an automotive vehicle in order to assure sufficient air flow through the radiator to cool the vehicle engine. These prior art fans consist of a hub, a number of circumferentially spaced fan blades mounted on the hub, each of the fan blades having a leading edge and a trailing edge.

Such prior art devices are normally of the axial flow type, such as the design disclosed in U.S. Pat. No. 4,050,847 (New et al) for a "Lightweight Fan". It has always been felt that axial-flow type cooling fans of the type illustrated in the New et al patent are best suited for automotive vehicles, because of the large volume of air that must be handled and the relatively low pressure drop. Furthermore, air enters the cooling system in an axial direction and does not alter direction until it is discharged to the engine bay. However, vehicle designers have tended to reduce the frontal area of the vehicles in order to lower the vehicle drag coefficient and therefore improve fuel economy. Accordingly, higher air path resistances have resulted, thereby requiring fans capable of generating higher pressures at the same or lower tip speeds. The conventional axial flow type cooling fan is therefore less able to handle the flow required. It is generally not an acceptable solution to merely increase the size of the fan, because power for the fan in the future will be generated by an auxiliary electric motor, and the size of such a motor and the inherent current draw required to operate a large axial flow fan makes such a design prohibitive.

Investigation of the flow characteristics through a conventional system shows that air takes a diagonal or oblique exit path across the fan blades, being propelled by both blade lift and centrifugal action. The higher the system drop, the more centrifugal action (i.e., air flow in the radial direction) is needed to handle the flow. Accordingly, a fan which imparts both radial and axial flow components to the air is needed for best performance.

Although automotive cooling fans which are ostensibly mixed flow have been proposed, such as that disclosed in U.S. Pat. No. 3,733,147 (Felker), the blades of the fan disclosed in the Felker patent impart only the axial flow component. The only air flow in the radial direction is caused by suction through a central chamber in the hub and by the centrifugal action of the fan, which forces the flow in the radial direction. In other words, the blades of the fan disclosed in the Felker patent do not impart both a radial and an axial flow component to the air flow.

The automotive cooling fan disclosed in this application is characterized in that the fan includes backing plate portions associated with each of the blades, the backing plate portions extending downstream from the hub. Each of the blades is disposed in a plane oblique to the plane of its corresponding backing plate portion, and intersects its corresponding backing plate portion to define a joining edge therebetween.

Because of the invention, an automotive cooling fan is proposed that is more efficient than those known in the prior art. The proposed cooling fan can handle increased air flows at higher pressures with the same size fan, since the fan disclosed herein combines the flow generating capability of axial thrust with the pressure generating capability of centrifugal lift. Furthermore, the capacity of the fan can be adjusted by merely trimming the trailing edges of the blades, which has the same effect in the fan of this invention as does a reduction in size of prior art fans. Fans must be designed for a particular installation, but it is always desirable that a fan design have maximum flexibility of application with the minimum of structural changes. Prior art axial flow fans required a change of diameter or change of design speed in order to adjust the fan capacity. The advantage of the fan disclosed in the present application is that this capacity may be changed with the aforementioned simple trimming of the trailing edges of the blades.

Other features and advantages will appear in view of the following description with reference to the assembly drawings in which.

Figure 1:
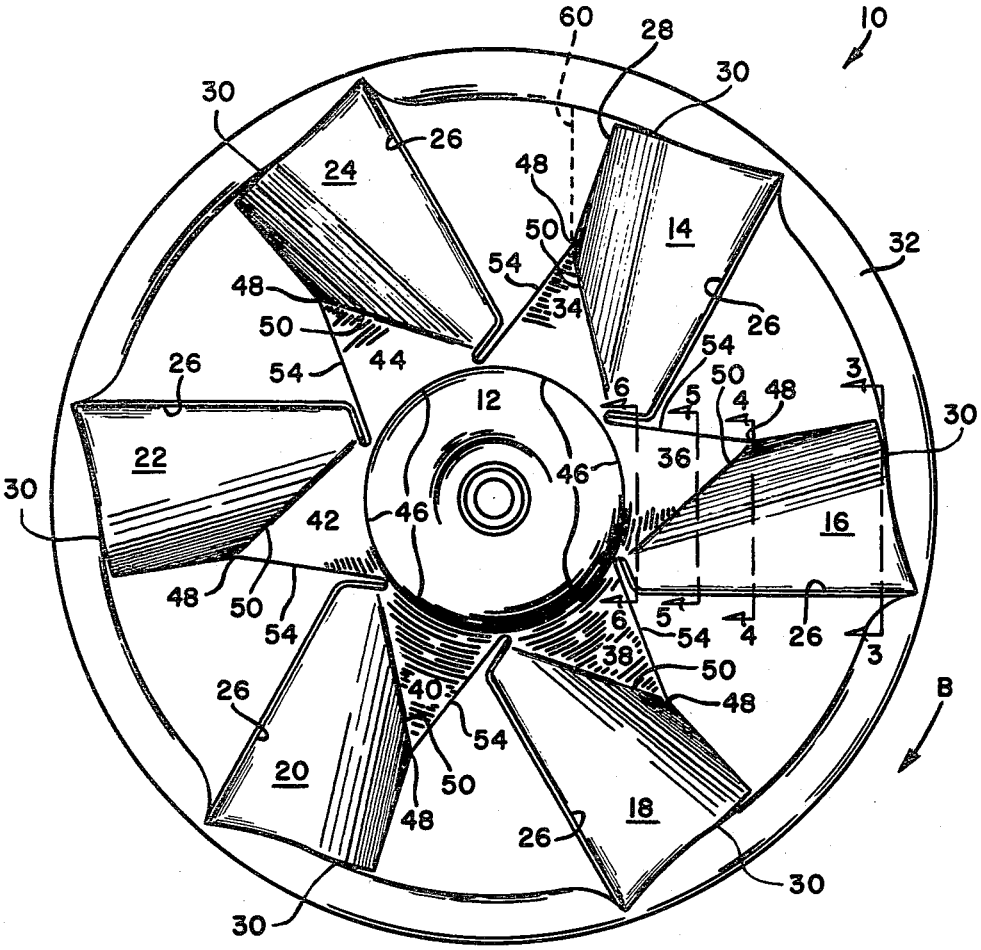
FIG. 1 is a plan view of an automobile engine cooling fan made pursuant to the teachings of my present invention.
Figure 3:
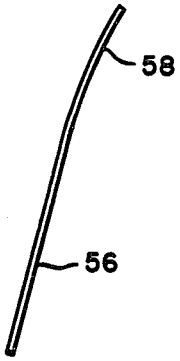
Figure 4:
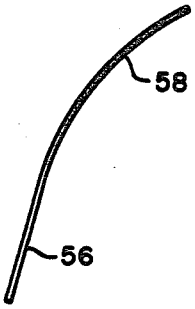
Figure 5:
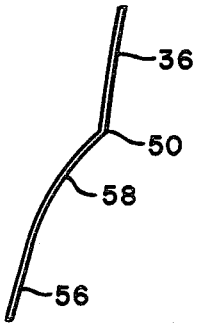

FIGS. 3, 4, and 5 are cross-sectional views taken along lines 3—3, 4—4, and 5—5 of FIG. 1, respectively.

Referring now to the drawings, an automobile engine cooling fan generally indicated by the numeral 10 includes a hub 12 which is secured to the driving spindle when the fan is installed on an automotive vehicle. Circumferentially spaced, radially projecting fan blades 14, 16, 18, 20, 22 and 24 are provided to force the air flow through the fan when the latter is rotated. Each of the blades 14–24 includes a leading edge 26, a trailing edge generally indicated by the numeral 28, and a tip end 30 which interconnects the outer extremities of the leading and trailing edges 26, 28. As can best be seen in FIG. 2, air flow through the fan is in the direction of the arrow A from the upstream side to the left of the fan viewing FIG. 2 to the downstream side to the right of the fan viewing FIG. 2, and the fan rotates in the clockwise direction indicated by the arrow B in FIG. 1. A flared ring 32 circumscribes the tip edges 30 of the blades 14–24 to stiffen the blades and reduce recirculation around the tips of the blades, thereby improving their efficiency. The sharply flared exit section 33 of the ring guides the discharge air in a conical direction, as will be described hereinafter.

Figure 2:
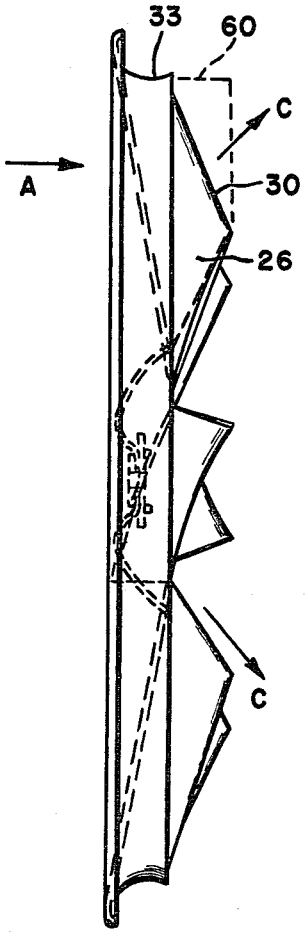
FIG. 2 is a cross-sectional view taken substantially along lines 2—2 of FIG. 1.

A corresponding backing plate portion 34, 36, 38, 40, 42, and 44, is associated with each of the fan blades 14–24. The backing plate portions 34–44 are generally triangular in shape and are joined to the hub 12 at their curved inner edge 46. The backing plate portions 34–44 lie on the conical surface of a right circular cone which extends downstream from the downstream side of the hub 12. In other words, if each of the apices 48 of the backing plate portions 34–44 were interconnected by a circle, the circle would be concentric with the hub 12 and would cooperate with the edges 46 of the backing plate portions to describe the upper and lower boundaries of a truncated right circular cone. The material between each of the corresponding backing plate portions 34–44 is removed to save weight, since the interconnecting portions would have little, if any, effect on the aerodynamics of the fan. As can be seen in FIGS. 1 and 2, the plane defined by the leading and trailing edges 26, 28 of the fan blades 14–24 define a plane which is oblique to the conical plane in which the backing plate portions 34–44 are described. Each of the fan blades 14–24 intersects its corresponding backing plate portion 34–44 along a joining edge 50, which extends between a point 52 on the surface 46 at which the leading edge 26 of the blade intersects the surface 46 to the point 48 at which the trailing edge 28 of the blades 14–24 intersects the corresponding edge 54 of the corresponding backing plate portions 34–44.

Figure 6:
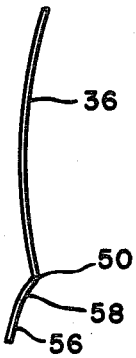

Referring now to FIGS. 3–6, which are cross-sectional views taken at various radii from the hub, it will be noted that the blade consists of a relatively flat or less curved portion 56 and a more sharply curved portion 58. Referring to FIG. 3, which is the cross section nearest the tip of the blade, it will be noted that the curved section 58 is not pronounced; however, as illustrated in FIGS. 4, 5, and 6, the curved portion becomes progressively more pronounced as the radii approaches the hub. As illustrated in FIGS. 5 and 6, the conical shape of the backing plate portion 36 intersects the larger curvature portion 58 of the blade at the joining edge 50. The curved portion 58 cooperates with the backing plate portion 36 in order to provide the radial flow component to the airflow through the fan. In other words, the portion 58 of the blade in cooperation with the backing plate 36 acts as a radial fan. As indicated by the dotted lines 60 on FIGS. 2 and 3, the fully bladed version of the fan has portions of the sections 58 of the blades that are disposed at almost right angles to the plane of the hub 12. However, since flow through the fan is in a conical direction indicated by the arrow C in FIG. 2, the performance of the blade may be adjusted by trimming the blades back from their fully bladed version so that the trailing edge is defined by the lines segment 28. Trimming the trailing edge blades as indicated in FIGS. 1 or 2 is the equivalent of reducing the working or effective diameter of an axial flow fan, since the flow in the fan illustrated in FIGS. 1–6 is conical. Accordingly, trimming the trailing edge of the blades results in a performance reduction similar to the effect of a diameter reduction in either a radial or axial flow fan.

In operation, the fan 10 is rotated in the direction of the arrow B by the vehicle engine. As the fan rotates, the portions of the blades 14–24 nearer the leading edge thereof, i.e., the portions of lessor curvature 56, impart an axial velocity component to the air flow similar to the axial component introduced by existing vehicle engine cooling fans. The more sharply curved portions 58 of the blades 14–24 cooperate with their corresponding backing plate portions 34–44 to provide a radial flow component to the flow. The resultant of the axial and radial velocity components introduced by the fan is a generally conical flow stream from the downstream side of the fan, as indicated by the arrows C in FIG. 2. The flared portion 33 of the ring 22 also tends to guide the flow into the conical stream.

I claim:

1. In a fan for imparting both axial and radial flow components to the air passing between the upstream and downstream sides of the fan, a hub, a plurality of circumferentially spaced fan blades, each of said fan blades having a leading edge and a trailing edge, characterized in that said fan includes backing plate portions associated with each of said blades, said backing plate portions being defined as circumferentially spaced sections of a common conical surface projecting from the downstream side of said hub, each of said blades being disposed in a plane oblique to the plane of said conical surface and intersecting its corresponding backing plate portion to define a joining edge therebetween.

2. The fan as claimed in claim 1, wherein said backing plate portions are generally triangular in shape.

3. The fan as claimed in claim 1, characterized in that each of said blades includes a transversely curved portion between the leading and trailing edges of each blade.

4. The fan as claimed in claim 3, characterized in that each of said blades includes sections having greater and lesser radii of curvature, the section of lesser radius of curvature terminating in said trailing edge of the blade.

5. The fan as claimed in claim 1, characterized in that the backing plate portions are defined by a joining edge engaging the joining edge of said blade and another edge extending from said hub and intersecting the joining edge.

6. The fan as claimed in claim 1, characterized in that the joining edge of each of said blades intersects the trailing edge thereof at a point between the backing plate and the tip end of the trailing edge, said backing plate portion cooperating with the trailing edge of its corresponding blade and the leading edge of the blade adjacent thereto to provide an opening permitting flow through the fan, the portion of the blade adjacent the trailing edge being trimmed to regulate the airflow through the fan.

7. The fan as claimed in claim 1, characterized in that a ring circumscribes the tips of each of said blades, said ring having a flared portion extending downstream from the tips of said blades.

8. In a fan for imparting axial and radial flow components to the air passing through the fan, a hub, a plurality of circumferentially spaced fan blades mounted on said hub and extending radially therefrom, a backing plate portion associated with each of said blades, said backing plate portions being defined on sections of a common conical surface projecting from said hub in the direction of air flow through the fan, each of said blades including a leading edge, a trailing edge, and a joining edge intersecting the trailing edge of the corresponding blade, said joining edge engaging said backing plate portion and joining said corresponding blade with its corresponding backing plate portion.

* * * * *